United States Patent [19]

Weil et al.

[11] Patent Number: 4,726,210

[45] Date of Patent: Feb. 23, 1988

[54] METHOD AND APPARATUS FOR MAKING CAN BODIES FROM SHEETS

[75] Inventors: Wolfgang Weil, Heitersheim, Fed. Rep. of Germany; Josef Locher, Oberrohrdorf, Switzerland

[73] Assignee: Elpatronic, AG, Switzerland

[21] Appl. No.: 870,443

[22] Filed: Jun. 4, 1986

[30] Foreign Application Priority Data

Jun. 11, 1985 [CH] Switzerland ..... 2454/85

[51] Int. Cl.[4] ..... B21D 5/14; B21D 51/26

[52] U.S. Cl. ..... 72/133; 72/171; 72/173; 72/175

[58] Field of Search ..... 72/51, 52, 133, 134, 72/148, 169, 171, 172, 173, 175, 370; 228/17.5, 150, 151

[56] References Cited

U.S. PATENT DOCUMENTS

| | | | |
|---|---|---|---|
| 2,197,906 | 4/1940 | Tucker | 72/175 |
| 2,309,963 | 2/1943 | Krueger | 72/51 X |
| 2,675,849 | 4/1954 | Greenshields et al. | 72/171 |
| 2,698,642 | 1/1955 | Malina | 72/173 |
| 3,738,149 | 6/1973 | Archer | 72/171 |
| 3,934,324 | 1/1976 | Hess et al. | 228/151 X |

FOREIGN PATENT DOCUMENTS

| | | | |
|---|---|---|---|
| 2110260 | 11/1979 | Fed. Rep. of Germany | 72/173 |
| 2517226 | 6/1983 | France | 72/171 |

*Primary Examiner*—E. Michael Combs

[57] ABSTRACT

Plane, rectangular sheets (10) are moved through between a driven bending roll (32) and a plurality of back-up rolls (34) and are bent round the bending roll (32) by these rolls and a plurality of pressure rolls (52, 56) disposed behind the bending roll (32) and back-up rolls (34). The almost completely rounded sheet (10) is bent resiliently away from the bending roll (32) by a deflecting member (62) as a result of which the front edge (10*a*) of the sheet is prevented from re-entering the gap between the bending roll (32) and the back-up rolls (34) before the rear edge (10*b*) of the sheet has travelled through this gap. Then the deflecting member (62) is moved back into its position of rest so that the front region of the sheet (10) springs back in the direction of the bending roll (32) and as a result is again gripped by the bending roll (32) and the back-up rolls (34) and moved through between them. When the front edge (10*a*) of the sheet (10) has reached the gap between the last two pressure rolls (56), all the pressure rolls (52, 56) are lifted. Then the sheet (10) is conveyed from a rounding station (31) to a positioning station (69). The sheet (10) continues to be rotated by the bending roll (32) until its front edge (10*a*) is arrested by catching levers (68). The rounded sheet (10) is now stripped axially off the bending roll (32).

11 Claims, 4 Drawing Figures

METHOD AND APPARATUS FOR MAKING CAN BODIES FROM SHEETS

Figure 1:
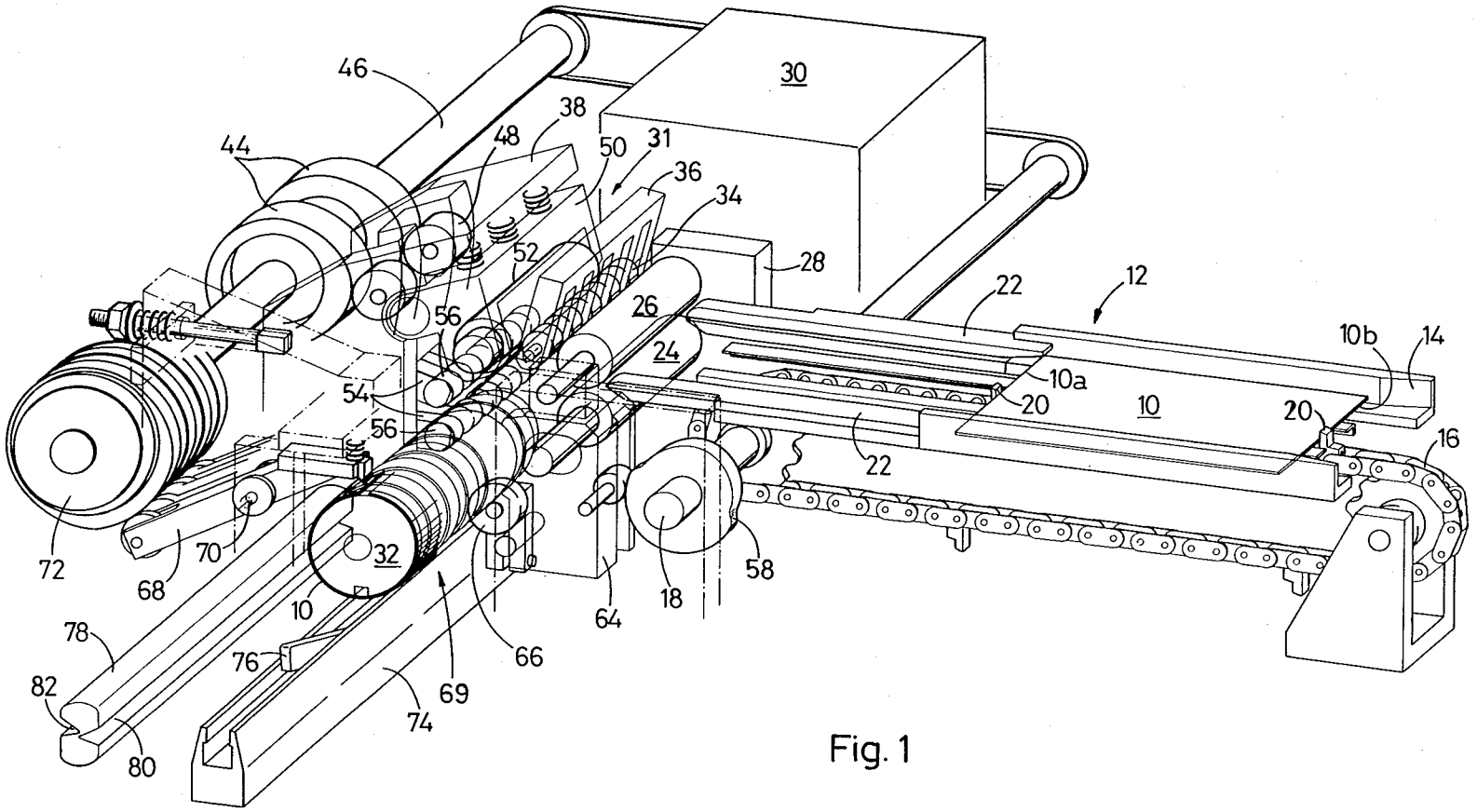

The invention relates to a method of making sheets round, particularly for can bodies, each sheet having a front and a rear edge which are subsequently connected to one another, particularly welded, wherein each sheet travels, with its front edge leading, between a driven bending roll and a plurality of back-up rolls and, assisted by at least one additional shaping element disposed behind the bending roll, is bent round the bending roll, the sustantially completely rounded sheet being resiliently widened as a result of which the front edge is kept away from the bending roll and the back-up rolls while the rear edge travels through between them. The invention further relates to an apparatus for carrying out this method.

In a known apparatus (DE-A 33 30 171) for carrying out such a method, following on a feed station consisting of two rolls and two slide members between which the sheets are fed is a preliminary bending station which likewise comprises a pair of rolls with one wedge-shaped bending member in front and one behind. Disposed behind that are two converging shaping members which are likewise wedge-shaped and which guide the sheets individually into a roll gap between an uppe and a lower bending roll. Disposed behind the roll gap is a further wedge-shaped shaping member which deflects each sheet downwards as it emerges from the roll gap so that it is laid round the lower bending roll. The lower one of the two shaping members disposed in front of the roll gap is hook-shaped so that it catches the front edge of the sheet and holds it while the rear portion of the sheet continues to run through between the bending rolls. As a result, the front edge of the sheet is prevented from re-entering the roll gap; the cylindrical sheet-metal member being formed widens out until the rear edge of the sheet has travelled through between the two bending rolls and then comes to a standstill bearing against the shaping member disposed behind the roll gap. Disposed below the shaping members are conveying pawls which finally push the cylindrical sheet-metal members axially away from the bending rolls into a guide with two grooves in which the front and rear edges of the sheet are guided in such a manner that they can be welded together behind it, overlapping one another.

This known apparatus and the method which can be carried out thereby have generally useful results if the diameter of the fully rounded sheet-metal member or body is very great in relation to the thickness of the sheet and the requirements regarding the precise rounding of the sheet-metal member are not too high, particularly in the region of its front edge.

With a relatively large thickness of sheet and/or relatively small diameter of the sheet-metal member, however, it becomes increasingly noticeable that the fully rounded sheet-metal members remain nearly plane in the region adjacent to their front edge and also to a certain extent in the region adjacent to their rear edge, but at least have a radius of curvature there which is considerably greater than the radius of the sheet-metal member as a whole. These inadequately rounded marginal regions can still be accepted in many cases if they are subsequently welded together with an overlap. Sometimes, however, difficulties arise even then; but such inadequatly rounded marginal regions have proved particularly disturbing in sheet-metal members, the front and rear edges of which are butt-welded together, for example by means of beam welding.

It is therefore the object of the invention to develop further a method of the type described at the beginning as well as an apparatus suitable for carrying out the method, in such a manner that the radius of curvature of the rounded sheet-metal member in the region of the front and rear edges coincides more precisely with the prescribed radius of curvature even when can bodies with a comparatively small diameter are produced from comparatively thick sheets.

According to the invention, the problem is solved, so far as the method is concerned, in that, while the driven bending roll continues to rotate, the resiliently widened sheet is allowed to relax again and the front edge is again allowed to travel through between the bending roll and the back-up rolls, following on the rear edge.

In contrast to the presupposed prior art, therefore, the front edge of the already largely rounded sheet-metal member is not finally caught in front of the roll gap which is formed between the bending roll and the back-up rolls and through which it has already travelled, but is held back until it can no longer come into an overlapping position with the rear marginal region of the sheet. As soon as the rear edge of the sheet has at least substantially travelled through between the bending roll and the back-up rolls, the sheet is released again in its front region so that it again travels through between the bending roll and backup rolls, more or less closely behind the rear edge, and in the course of this is given a radius of curvature which is better adapted to the diameter of the finished sheet-metal member.

In a preferred way of carrying out the method according to the invention, in order to widen the sheet resiliently, its portion following on the front edge is moved away from the inner bending roll at least substantially counter to the entry direction. It would also be possible, however, to capture the front edge of the sheet in the known manner with a hook-shaped member provided this is so shaped and movable that it releases the front edge of the sheet in good time for the second passage between the bending roll and the back-up rolls.

In the method according to the invention, the front edge—which has travelled through between the bending roll and the back-up rolls for the second time—of the fully rounded sheet can be caught after the displacement and the sheet can be pushed axially away from the bending roll into a guide in which the front and rear edges are brought into a position in which they are connected to one another, particularly welded. These method features—known apart from the second passage of the front edge of the sheet—can be further developed according to the invention in that the front edge is caught, following on the second passage between the bending roll and the back-up rolls, only after it has travelled, also through between at least one additional shaping element and the bending roll for the second time. As a result, the accuracy of shape of the rounded sheet is still further improved in the region adjacent to its front edge.

The procedure last described can be perfected in that, beginning with the first passage of its front edge between the bending roll and the back-up rolls, the sheet is allowed to cover a distance of about 420° to 480°, preferably 440° to 460° round the bending roll, under the action of the at least one additional shaping element.

Finally, it is an advantage if the sheet is then freed from the action of every additional shaping element, is moved from the rounding station into the positioning station, further rotated, and its front edge only caught after approximately two complete revolutions. In this manner, the rounded sheet can be brought particularly accurately into a defined position in which it can be prepared for further processing, particularly for the butt-welding of its front and rear edges.

An apparatus which corresponds to the known one described in that it is equipped with a feed section for the feed of plane sheets, a bending roll and at least one additional shaping element disposed behind that, is particularly suitable for carrying out the method according to the invention. According to the invention, such an apparatus is further developed in that, in order to widen the partially rounded sheet, a deflecting member is provided which can be moved away from the bending roll at least substantially radially.

In a preferred form of embodiment, the deflecting member has a sickle-shaped cross-section, is adapted, by its concave side, to the bending roll and bears at least approximately against it when it assumes its position of rest. During the rounding, the sheet can be moved over such a deflecting member, without disturbance, until its front edge has again approached so close to the roll gap between the bending roll and the back-up rolls that the front region of the sheet has to be deflected away from the bending roll by the movement provided for the deflecting member. Other forms of embodiment of the deflecting member are, however, also conceivable. Thus the deflecting member could be formed by a sector of the bending roll itself, which could be extended radially, or by an electromagnet which is disposed outside the region where the sheet is rounded round the bending roll and which, in the magnetized state, attracts the front region of the partially rounded sheet.

Regardless of how the deflecting member is formed in detail, an advantageous further development of the invention consists in that at least one additional shaping element disposed behind the bending roll or back-up rolls is resiliently supported at least substantially radially with respect to the bending roll and comprises a pressure roll. As a result, it is possible to exert considerable forces, which are radial with respect to the bending roll, on the sheet without an appreciable resistance being opposed to its movement round the bending roll.

Behind the bending roll and the back-up rolls, a plurality of pressure rolls, which are resilient in various directions which are at least substantially radial with respect to the bending roll, are preferably disposed on a common carrier which is adjustable, as a whole, towards the bending roll and away from it.

Figure 2:
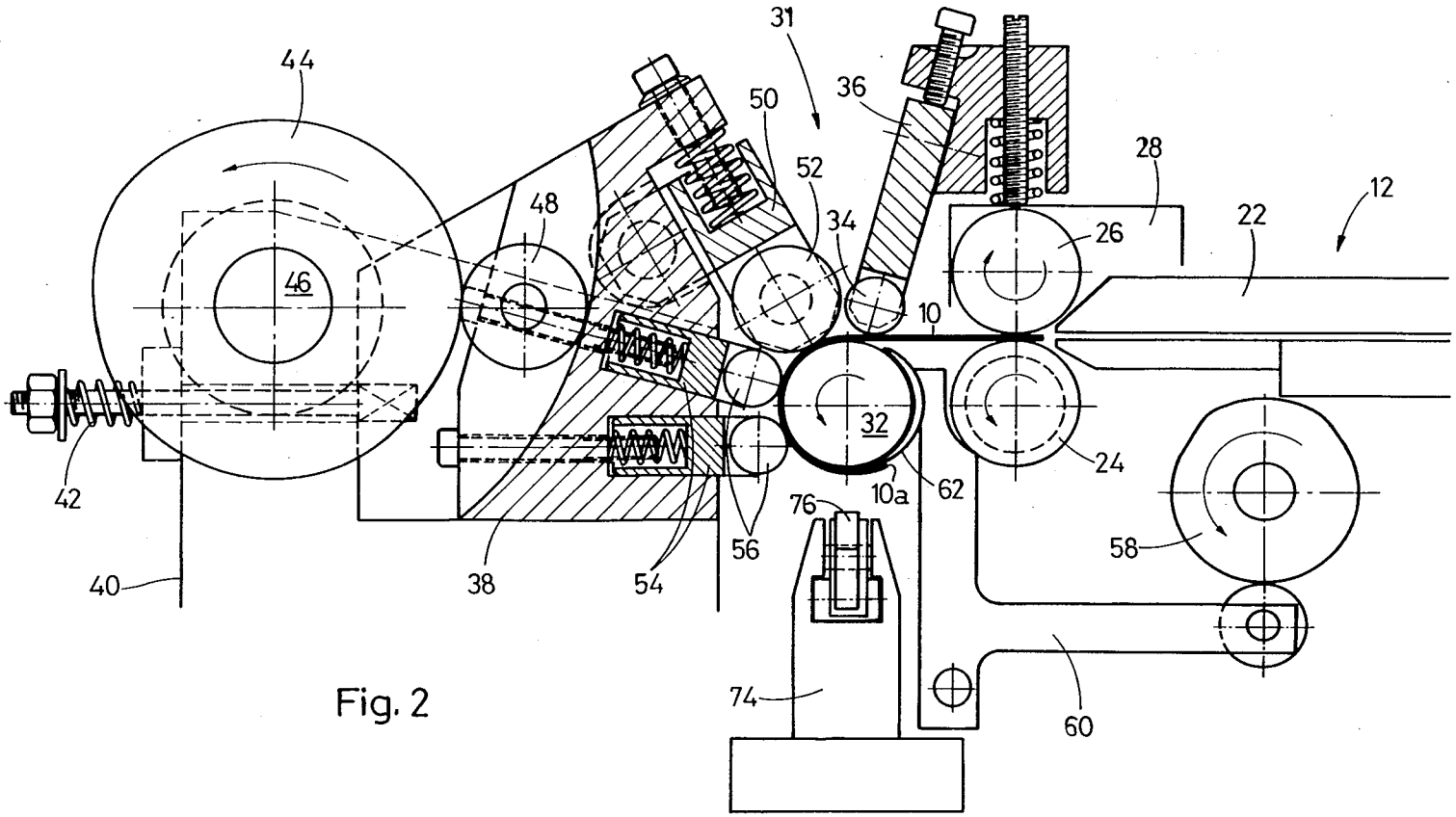
Figure 3:
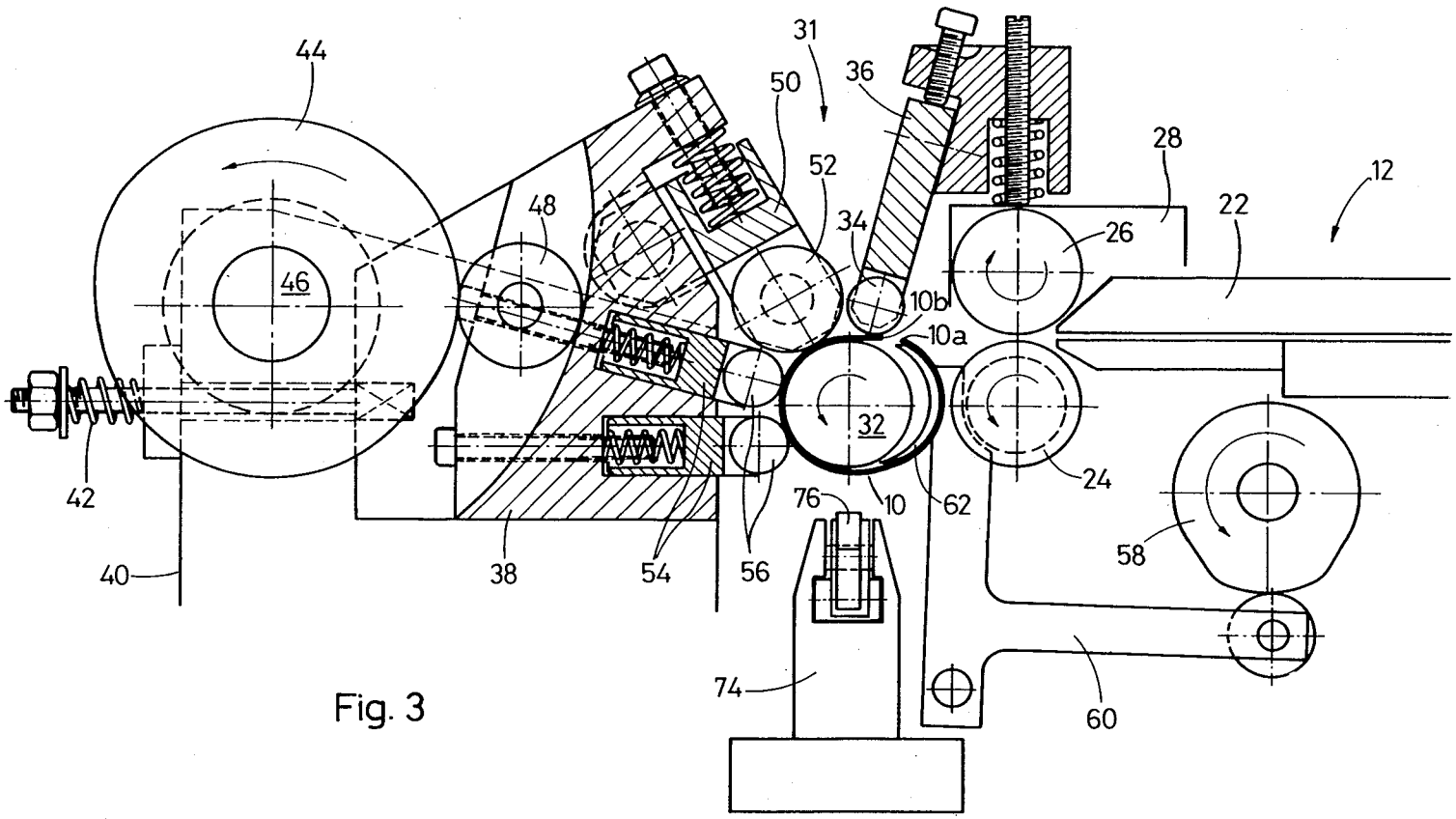
Figure 4:
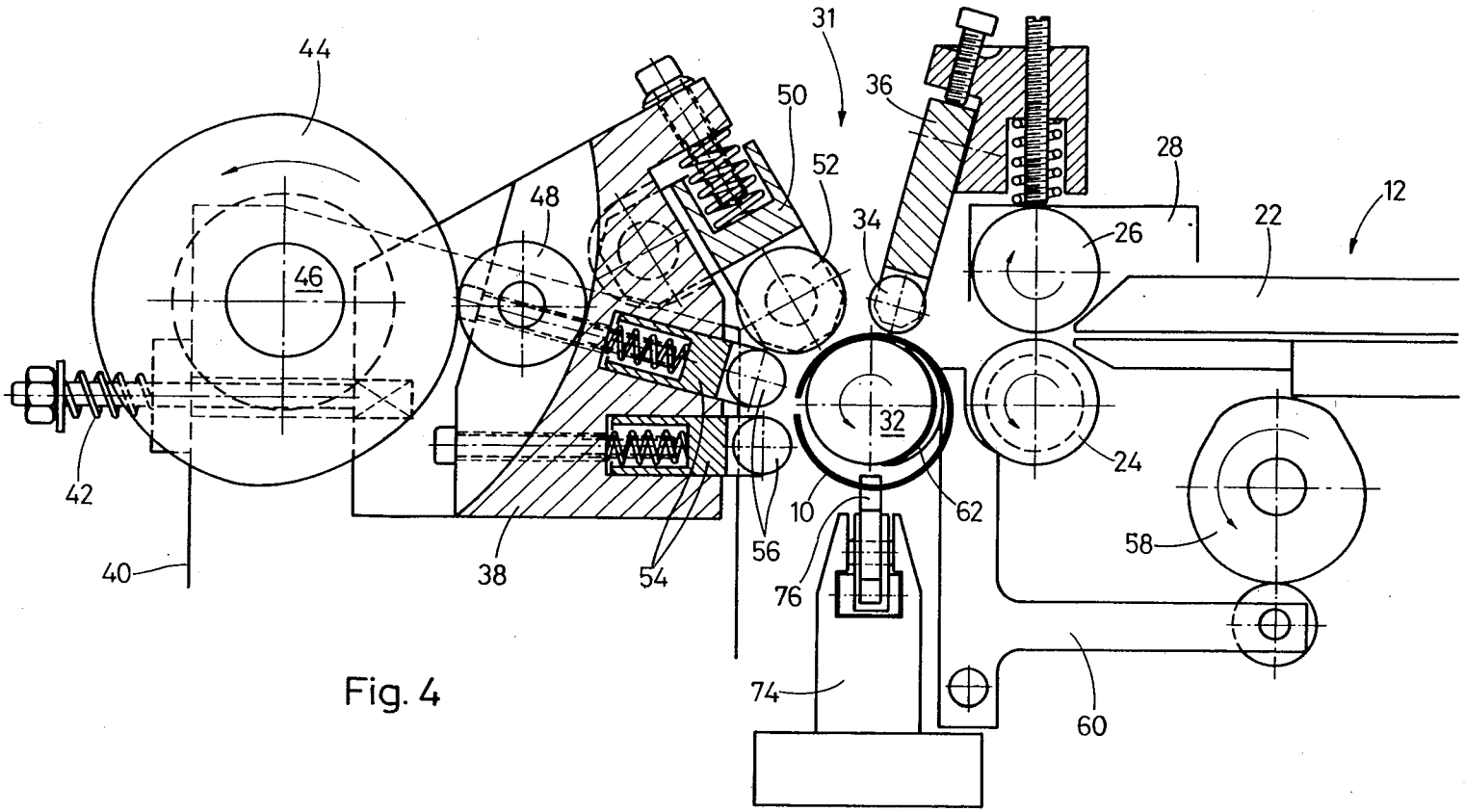

Examples of embodiment of the invention are explained below, with further details, on the basis of diagrammatic drawings: in these FIG. 1 shows an oblique view of an apparatus according to the invention for rounding can sheets and FIGS. 2 to 4 show a vertical section of the apparatus in three different working positions.

The apparatus illustrated serves the purpose of making plane, rectangular sheets 10 of tin plate with a thickness of 0.3 mm for example, into round can bodies with a diameter of 40 mm for example. The sheets 10 each have a front edge 10*a* and a rear edge 10*b* which, after the rounding, should be disposed parallel to one another with slight spacing; the rounding should extend as uniformly as possible as far as these two edges 10*a* and 10*b*.

The apparatus illustrated has a feed section 12 with a loading station 14 in which the sheets 10 are inserted individually. Extending below the loading station 14 is the upper strand of a conveyor chain 16 which can be driven step-by-step by a drive shaft 18 and comprises pusher dogs 10 at intervals corresponding to the length of the sheets 10. Extending from the loading station 14 are parallel guide rails 22 which guide the sheets 10 at both sides as well as at the top and bottom, as far as a roll gap between two horizontal conveying rolls 24 and 26 disposed vertically one above the other. The upper conveying roll 26 is mounted on a vertically adjustable conveying-roll carrier 28 which is resiliently preloaded downwards. Both conveying rolls 24 and 26 can be driven by a motor, not illustrated, through a gearbox 30 to which the drive shaft 18 is also connected.

Disposed behind the conveying rolls 24 and 26 are a bending roll 32 and a plurality of back-up rolls 34, the axes of rotation of which are likewise disposed horizontally and parallel to one another but in such a manner that the plane defined by the axes converges upwards with the vertical plane in which the axes of rotation of the two conveying rolls 24 and 26 lie. The bending roll 32 is called a bending roll because the sheet 10 is rolled round it; this bending roll 32, like the lower conveying roll 24, is mounted in a fixed position and can be driven in rotation, in the same direction as this, from the gearbox 30. The outer back-up rolls 34 have a considerably smaller diameter than the bending roll 32 and are mounted on a roll carrier 36 which is adjustable radially with respect to the bending roll 32, according to the characteristics of the sheet 10, particularly the sheet thickness.

Behind the bending roll 32 and the back-up rolls 34, a carrier 38 is guided on a stationary guide 40 which extends horizontally and transversely to the bending roll 32 and the back-up rolls 34. The carrier 38 is preloaded by a spring 42 which tends to pull it away from the inner bending roll 32; this spring 42 is counteracted by eccentrics 44 which are secured to a shaft 46 driven from the gearbox 30 and each of which can roll on a roller 48 mounted on the carrier 38. Pivotally mounted on the carrier 38 is a shaping element 50 on which a pressure roll 52 is mounted coaxially. The shaping element 50 is adjustable and is resiliently preloaded in such a manner that the pressure roll 52 tends to roll on the bending roll 32.

Guided on the carrier 38 for displacement substantially radially with respect to the inner bending roll 32 are two further shaping elements 54 on which pressure rolls 56 are mounted, the diameter of which corresponds substantially to that of the back-up rolls 34 and is considerably smaller than the diameter of the pressure rolls 52. The shaping elements 54 are likewise adjustably preloaded in such a manner that the pressure rolls 56 tend to roll on the bending roll 32.

Secured to the drive shaft 18 is a cam plate 58 which controls a bell-crank lever 60. Secured to the bell-crank lever 60 is the one end of an elongated deflecting member 62 of sickle-shaped cross-section which is disposed parallel to the bending roll 32. In FIGS. 2 and 4, the deflecting member 62 is illustrated in a position of rest in which it bears at least approximately against the peripheral surface of the bending roll 32; as shown in FIG. 3, the deflecting member 62 can be moved out of this position of rest, substantially radially away from the bending roll 32, in the direction of the lower conveying roll 24.

Also controlled by the cam plate 58, according to FIG. 1, is a pivotable bearing block 64 on which a back-up roller 66 is mounted to support the bending roll 32.

According to FIG. 1, a group of hook-shaped catching levers 68 is mounted for pivoting about a stationary pin 70, substantially opposite the back-up roller 66 with respect to the bending roll 32. The catching levers are controlled by cam plates 72 which are secured to the shaft 46.

Constructed parallel to the axis of the bending roll 32 and below it is a removal section 74 on which pivotable catches 76 can be moved backwards and forwards. Likewise disposed parallel to the axis of the bending roll 34 and in axial continuation thereof, adjacent to the observer in FIG. 1, is a guide 78 which has a groove 80 and 82 respectively in each of its two sides and as a result has a substantially Z-shaped section.

The apparatus described works as follows:

During each working cycle of the apparatus, a sheet 10 is conveyed from the loading station 14 to the conveying rolls 24, 26 and gripped by these. During the next working cycle, the sheet 10 is conveyed by the conveying rolls 24, 26 to the bending roll 32 and the back-up rolls 34, is gripped by the pressure roll 52 and is bent round the bending roll 32. In the course of this, the deflecting member 62 at first assumes the position of rest illustrated in FIG. 2, in which the sheet 10 runs onto the deflecting member 62 during the rounding. Immediately afterwards, the deflecting member 62 is moved out of its position of rest as shown in FIG. 2 into its position remote from the bending roll 32 as shown in FIG. 3. As a result, the front edge **10*a* of the sheet 10 is prevented from striking against the rear region of the sheet and entering, together with this, the gap between the bending roll 32 and the back-up rolls 34. As soon as the rear edge 10*b* of the sheet 10 has travelled through the gap between the bending roll 32 and the back-up rolls 34 during continued rotation of the bending roll 32, however, the deflecting member 62 is moved back into its position of rest so that now the front edge 10*a* of the sheet 10 re-enters the gap between the bending roll 32 and the back-up rolls 34 and travels through this as well as through the gap between the bending roll 32 and the first pressure roll 52**.

When the front edge **10*a* has reached the gap between the two pressure rolls 56, the operation of rounding is regarded as terminated and the carrier 38 is moved away from the bending roll 32 so that all the pressure rolls 52 and 56 lose contact with the sheet 10 as shown in FIG. 4. The sheet 10 is then pushed from a rounding station 31 into a positioning station 69 by a catch 76. As a result of continued drive of the bending roll 32, the sheet 10 then continues to be rotated until the hook-shaped catching levers 68 engage in the gap which has remained open between front edge 10*a* and rear edge 10*b* of the sheet. As a result, the rotation of the sheet is ended and at the same time the back-up roller 66 is moved away from the bending roll 32 so that the sheet can now be pushed by one of the catches 76 axially away from the bending roll into the guide 78, the front edge 10*a* entering the groove 80 and the rear edge 10*b* entering the groove 82**.

We claim:

1. Apparatus for bending sheets, each sheet and having a front and rear edge, said apparatus comprising:

feed means receiving a sheet at the front edge:

bending means including a bending roll, a plurality of backup rolls and at least one shaping element, said bending means receiving the sheet from said feed means for bending the sheet along an outer surface of said bending roll:

deflection means cooperatively located with said bending roll at a first position for receiving the front edge of the sheet and deflecting the sheet away from said bending roll outer surface along a deflection surface; and displacement means moveable relative to said bending roll responsive to a position of the sheet about the bending roll outer surface, said displacement means for displacing said deflecting means outwardly from said first position for resiliently widening the sheet, said displacement means displacing said deflecting means back to said first position, allowing the sheet to continue along said bending roller outer surface.

2. The apparatus as claimed in claim 1, wherein said deflecting means further comprises a deflecting member that has a sickle-shaped cross-section with its concave side facing said outer surface of said bending roll (32).

3. The apparatus as claimed in claim 17 wherein said bending apparatus further comprises a pressure roll means resiliently supported at least substantially radially relative to the bending roll (32).

4. The apparatus as claimed in claim 3, wherein said pressure roll means comprises a plurality of pressure rolls (52, 56) on a common carrier (38) which is adjustable towards and away from the bending roll (32).

5. A method of bending sheets, each sheet having a front and rear edge, said method comprising the steps of:

feeding a sheet at the front edge between a driven bending roll and a plurality of back-up rolls;

bending the sheet around the bending roll along an outer surface of said bending roll;

separating the sheet from said bending roll outer surface at a selected position thereof, said sheet passing along a surface of a deflection member located at a first position;

displacing said deflection member from said bending roll radially outward from said first position as said deflection member receives the sheet, resiliently widening the sheet;

displacing said deflection member inwardly toward said first position after the sheet rear edge has engaged said bending roll outer surface; and feeding the sheet front edge again between said bending roll and said plurality of backup rolls, said front sheet edge following said rear sheet edge along said bending roll outer surface.

6. The method according to claim 5 further comprising the step of displacing the sheet away from said bending roll at least substantially counter to a direction of sheet feed.

7. The method according to claim 5 further comprising the steps of pushing the sheet along a bending roll axis into a guide in which the front and rear sheet edges are brought into a position in which they can be connected.

8. The method according to claim 5 wherein said bending step includes the step of passing the sheet along said bending roll between a shaping element.

9. The method according to claim 7 wherein sheet front edge passes between said shaping element and said bending roll at least twice.

10. The method according to claim 9 further comprising the step of rotating the sheet substantially between 420° to 480° about said bending roll outer surface.

11. The method according to claim 10 further comprising the steps of freeing the sheet from said shaping element locating the sheet at a positioning station and rotating the sheet front edge two complete revolutions before positioning the sheet into said guide.

* * * * *

UNITED STATES PATENT AND TRADEMARK OFFICE

CERTIFICATE OF CORRECTION

PATENT NO. : 4,726,210

DATED : February 23, 1988

INVENTOR(S) : Wolfgang Weil and Josef Locher

It is certified that error appears in the above-identified patent and that said Letters Patent is hereby corrected as shown below:

Column 1

Line 13, delete "sustantially" and substitute--substantially--.

Line 27, delete "uppe" and substitute--upper--.

Line 68, delete "inadequatly" and substitute--inadequately--.

Column 2

Line 31, delete "backup" and substitute--back-up--.

Column 3

Line 64, delete "for example".

Column 4

Line 6, delete "10" and substitute--20--.

Column 5

Line 61, delete "and".

Line 63, delete ":" and substitute--;--.

Line 68, delete ":" and substitute--;--.

UNITED STATES PATENT AND TRADEMARK OFFICE

CERTIFICATE OF CORRECTION

PATENT NO. : 4,726,210

DATED : February 23, 1988

INVENTOR(S) : Wolfgang Weil and Josef Locher

It is certified that error appears in the above-identified patent and that said Letters Patent is hereby corrected as shown below:

Column 6

Line 18, delete "17" and substitute--1--.

Signed and Sealed this

Seventeenth Day of October, 1989

*Attest:*

DONALD J. QUIGG

*Attesting Officer*

*Commissioner of Patents and Trademarks*